United States Patent [19]

Di Monte

[11] 4,384,256

[45] May 17, 1983

[54] DIAGNOSTIC IGNITION SPARK DETECTOR

[76] Inventor: Ronald J. Di Monte, 30 W. 116 Argyll La., Naperville, Ill. 60540

[21] Appl. No.: 245,156

[22] Filed: Mar. 18, 1981

[51] Int. Cl.[3] ..... F02P 17/00

[52] U.S. Cl. ..... 324/396

[58] Field of Search ..... 324/396, 397, 398

[56] References Cited

U.S. PATENT DOCUMENTS 1,343,372 6/1920 O'Gorman ..... 324/396
1,429,329 9/1922 Donaldson ..... 324/396
1,484,335 2/1924 Kerringan ..... 324/396 X
1,525,539 2/1925 Gavlak ..... 324/396

FOREIGN PATENT DOCUMENTS 363866 11/1922 Fed. Rep. of Germany ..... 324/396

*Primary Examiner*—Stanley T. Krawczewicz
*Attorney, Agent, or Firm*—Wm. A. Snow

[57] ABSTRACT

A device used to visually detect the presence of a spark in internal combustion engines employing one or more spark plugs without removing the spark plug from the engine block.

3 Claims, 3 Drawing Figures

DIAGNOSTIC IGNITION SPARK DETECTOR

SUMMARY OF THE INVENTION

A device placed over the existing spark plug employing a plastic skirt or shield extending below the upper end of the spark plug, a conical coiled spring with expanded coils surrounding the porcelain body of the existing spark plug with the lower end encircling and grounding the metal portion of the spark plug to the hexagonal portion thereof, the lower end of the skirt lying in the spark plug well of the engine, an upper hollow member from which the skirt depends having an upper wall, a depending sleeve axially positioned on said wall, a headed screw frictionally seated in the sleeve with the head of the screw seated above the wall, a metal cup frictionally seated on the screw head, the lower end of said screw extending below said sleeve, a bottom wall integrally formed on said hollow member and provided with an integrally formed cap for seating on the upper metal end of the spark plug and an upwardly extending sleeve positioned to one side of the cap, the upper end of the spring being bent at right angles and frictionally seated in said upstanding sleeve, the free end of the upper end of said spring being again bent at right angles, flattened and positioned immediately below the lower end of the screw whereby said spark plug is completely shock-proof.

DETAILED DESCRIPTION OF THE DRAWINGS

Figure 1:
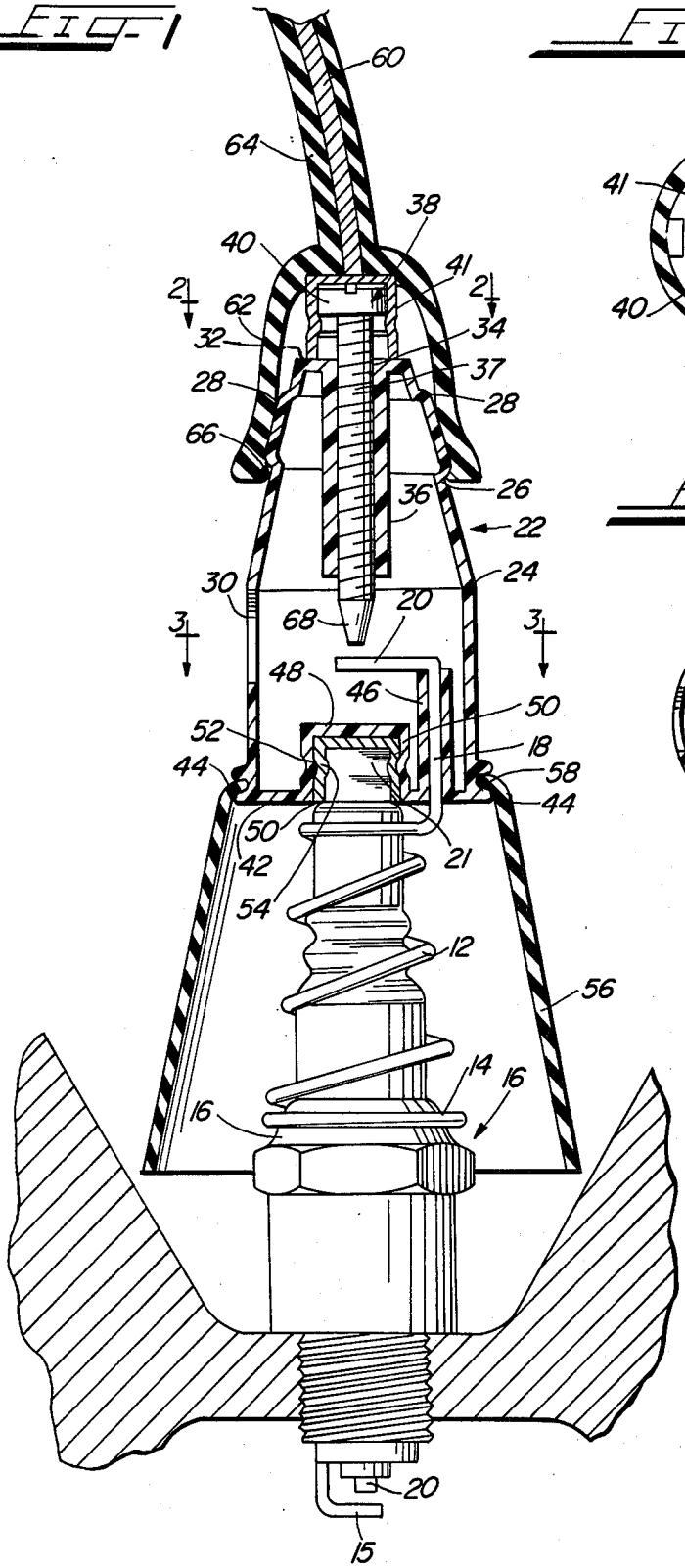
FIG. 1 is an enlarged, vertical, cross-sectional view of the device of the present invention secured to a spark plug.
Figure 2:
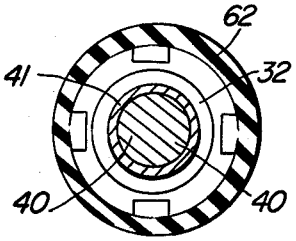
FIG. 2 is a cross-sectional view taken on lines 2—2 of FIG. 1.
Figure 3:
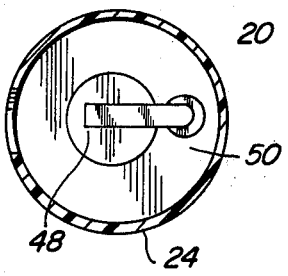
FIG. 3 is a cross-sectional view taken on lines 3—3 of FIG. 1.

The spark plug 10 is of the usual and normal type used in connection with internal combustion engines, such as used in snow blowers, grass cutters, motorcycles, and the like.

One does not know whether a spark plug is sparking under normal circumstances without removing the spark plug to visually inspect the same. With the present invention, one may visually detect the presence of spark without removing the plug.

In the main embodiment of the present invention, a coiled spring 12, having expanded coils to accommodate various lengths of spark plugs, is placed around the spark plug so that the lower end 14 of the spring encircles and contacts the hexagonal metal 16 of the spark plug 10. The upper or opposed end of the spring is vertically disposed as at 18 and its upper terminal end 20 is positioned at right angles thereto and would be flat, to lie directly above the upper end 21 of the positive post of the spark plug, and a portion is in alignment therewith to take the place of the negative post of the spark plug. The spring coil the shorts out the usual grounding or negative electrode 15.

A hollow, frusto-conical shaped rubber or other insulating material skirt 58 lies around but spaced from the spark plug 10. The upper end thereof is provided with an inturned flange 58.

A hollow upper plastic or other insulating material body 22 is elongated with the lower integral portion 24 being cylindrical. The lower end of said cylindrical portion is provided with a seat 44 to receive the flange 58 of the skirt. The upper portion 26 is tapered upwardly from the cylindrical portion 24 and is provided with four equi-spaced protrusions 28. The cylindrical portion 24 is provided with a viewing opening or window 30. The upper portion 26 is provided with an integrally formed top wall 32 having an opening 34 in which depends an integrally formed, elongated, cylindrical, plastic or other insulating material sleeve 36 to receive the shank 37 of a headed screw 38. The head 40 of the screw is cylindrical and has a screwdriver slot therein for adjusting the screw relative to the grounding or negative electrode 20. The interior diameter of the sleeve 36 is slightly smaller than the diameter of the shank of the screw 38 whereby the screw may be adjustably and frictionally held therein. The body 22 would preferably be constructed of a dark colored, non-resilient plastic for readily viewing the spark when present through the window or opening 30.

A cylindrical, hollow metal clip 41 seats on the upper end wall 32 and snugly encircles the head 40 of the screw. The lower end wall 42 of the cylindrical member 22 is integrally formed thereon and has an integrally formed, plastic sleeve 46 extending upwardly therefrom at one side of said wall 42 (as shown in FIG. 1) in which the vertical portion 18 of the spring seats. An integrally formed, upwardly extending cap 48 is integrally formed on the end wall medially thereof.

A metal cap 50 is removably secured but snugly seats on the upper end of the normal metal positive pole 21 of the spark plug 10, and is provided with a circular detent 52 which seats in the usual groove 54 in the spark plug. The plastic cap 48 snugly seats on the clip 50 by a groove and detent arrangement. Thus, because of the plastic cap 48, this makes the spark plug positive pole 20 an electrical nullity.

Thus, from the foregoing, it should be obvious that substantially all the plastic or other insulating material parts extend in a vertical direction.

The usual insulated wire 60 from the distributor contacts the metal clip 40, as shown in FIG. 1, and hence has a direct connection to the screw 38. The tip 68 in the shape of inverted truncated cone now acts as the positive electrode. Also, the usual cap or cover 62 integrally formed and depending from the insulation 64 covers the upper end of the body 22. This cap 62 has the usual bulbous peripheral end 66 which seats against the lower ends of the protrusions 28 to retain the cap 62 in place.

The screw is, of course, adjustable to vary the distance between the right angled flat wire 20 and the end 68 of the screw because most spark plugs require different spacing of negative and positive elements.

It should be noted that the member 22, including top wall 32, sleeve 36, sleeve 46 and bottom wall 50 with its cap member 48, is made of plastic or other insulating material.

In operation, the internal combustion engine is shut off and the cap 62 is removed from the spark plug. The metal cap 50 is placed on the positive terminal 21 of the spark plug and wire coil 12 is placed over the plug, as shown, along with the upper body 22, so that the right angled portion seats, as shown. The integral cap 48 is simultaneously frictionally secured to the metal cap 50 by force fitting the two together. The screw 38 is then adjusted for the proper gap between its end 68 and the right angled flat wire 20. The flange 44 of the skirt 56 is then secured in seat 44. The metal cap 41 is then snugly seated on the head of the screw and the rubber cap 62 positioned on the body 22 so that the wire 60 contacts the metal cap 41.

Most internal combustion engines of the type having a single spark plug are actuated by a rope, and to start them, the rope is vigorously pulled upwardly or outwardly.

To test the spark plug, all the fuel is shut off from the engine and the rope pulled vigorously to turn the engine over several times whereby the person pulling the rope can view through the window or opening 30 to see if a spark emits at the gap between the members 20 and 68. This invention, of course, is to test the spark plug producing capabilities of the engine components.

Where the engine has an electric starter, the engine is activated (without petrol) to note the sparking capabilities.

It should be obvious that the coiled spring 12 may be eliminated and one end of a wire from the lower end of member 18 is clipped thereto. The opposite end of the wire could be grounded to the motor block. Also, the skirt 56 may be in the form of a rubber, or other insulating material, bellows.

Although but one specific embodiment of this invention is herein shown and described, it will be understood that details of the construction shown may be altered or omitted without departing from the spirit of the invention as defined by the following claims.

I claim:

1. A diagnostic ignition spark detector in an internal combustion engine comprising a spark plug, hollow means for spacedly enveloping said spark plug, an upper hollow member, said means depending from said upper member, upper and lower partial walls on said upper member, a cap extending upwardly from said lower wall, a sleeve extending upwardly from said lower wall adjacent said cap, a sleeve depending from said upper wall, an elongated heated screw frictionally disposed in said depending sleeve, the head of said screw extending above said sleeve and the lower end extending below said sleeve, a metal cap frictionally encompassing the head of said screw, a portion of said screw extending below said sleeve, an expanded metal coiled spring surrounding said spark plug with the lower end grounded on the metal portion of said plug, the upper end of said spring being bent at right angles and frictionally seated in said upstanding sleeve, the free end of said upper end of said spring being bent at right angles, flattened and positioned directly below the lower end of said screw, and a viewing window in said upper hollow member.

2. The device according to claim 1 wherein said means to envelop said spark plug, said upper member, said sleeves and said cap extending upwardly from said lower wall is constructed of insulating material.

3. The device according to claim 1 wherein the lower end of said screw is tapered downwardly.

* * * * *